United States Patent [19]

Bertelsen

[11] Patent Number: 4,536,253

[45] Date of Patent: Aug. 20, 1985

[54] PROCESS FOR CONTROLLING THE PROPERTIES OF WHITE LIQUOR

[75] Inventor: Per M. Bertelsen, Allerod, Denmark

[73] Assignee: Kemotron A/S, Lyngby, Denmark

[21] Appl. No.: 423,254

[22] Filed: Sep. 24, 1982

[30] Foreign Application Priority Data

Sep. 25, 1981 [DK] Denmark ..... 4242/81

[51] Int. Cl.[3] ..... D21C 11/12

[52] U.S. Cl. ..... 162/30.11; 162/49; 162/62; 436/150

[58] Field of Search ..... 162/49, 61, 62, 30.1, 162/30.11; 436/150

[56] References Cited

U.S. PATENT DOCUMENTS

| | | | |
|---|---|---|---|
| 3,553,075 | 1/1971 | Rivers | 162/49 |
| 3,607,083 | 9/1971 | Chaudhry | 162/49 |
| 4,042,328 | 8/1977 | Seymour | 162/49 |
| 4,236,960 | 12/1980 | Hultman | 162/30.11 |

*Primary Examiner*—William Smith

*Attorney, Agent, or Firm*—Oblon, Fisher, Spivak, McClelland & Maier

[57] ABSTRACT

In the causticization part of the sulphate process the conductivity of the green liquor and the white liquor is measured, and the specific gravity of the green liquor is measured to determine the TTA-value (total titratable alkaline). The measuring values are registered on-line in a data processor calculating the required change of the supply of quicklime or green liquor to the slaker and/or the required change of the TTA-value of the green liquor for the control of the properties of the white liquor.

The measurings carried out provide the basis of a control of the properties or composition of the white liquor, whereby the causticization process forming part of the sulphate process is simplified and made more efficient. The drawbacks associated with an insufficient control, e.g. calcification and the consequent poorer filtratability of the white liquor as well as a too high content of calcium in the white liquor, cause calcification of filters, pipes, pumps, and digesters etc. An efficient control of the properties or composition of the white liquor facilitates the preparation of pulping liquor to be used in the sulphate process, and an efficient use of the raw materials necessary for carrying out the process is thereby obtained.

12 Claims, 1 Drawing Figure

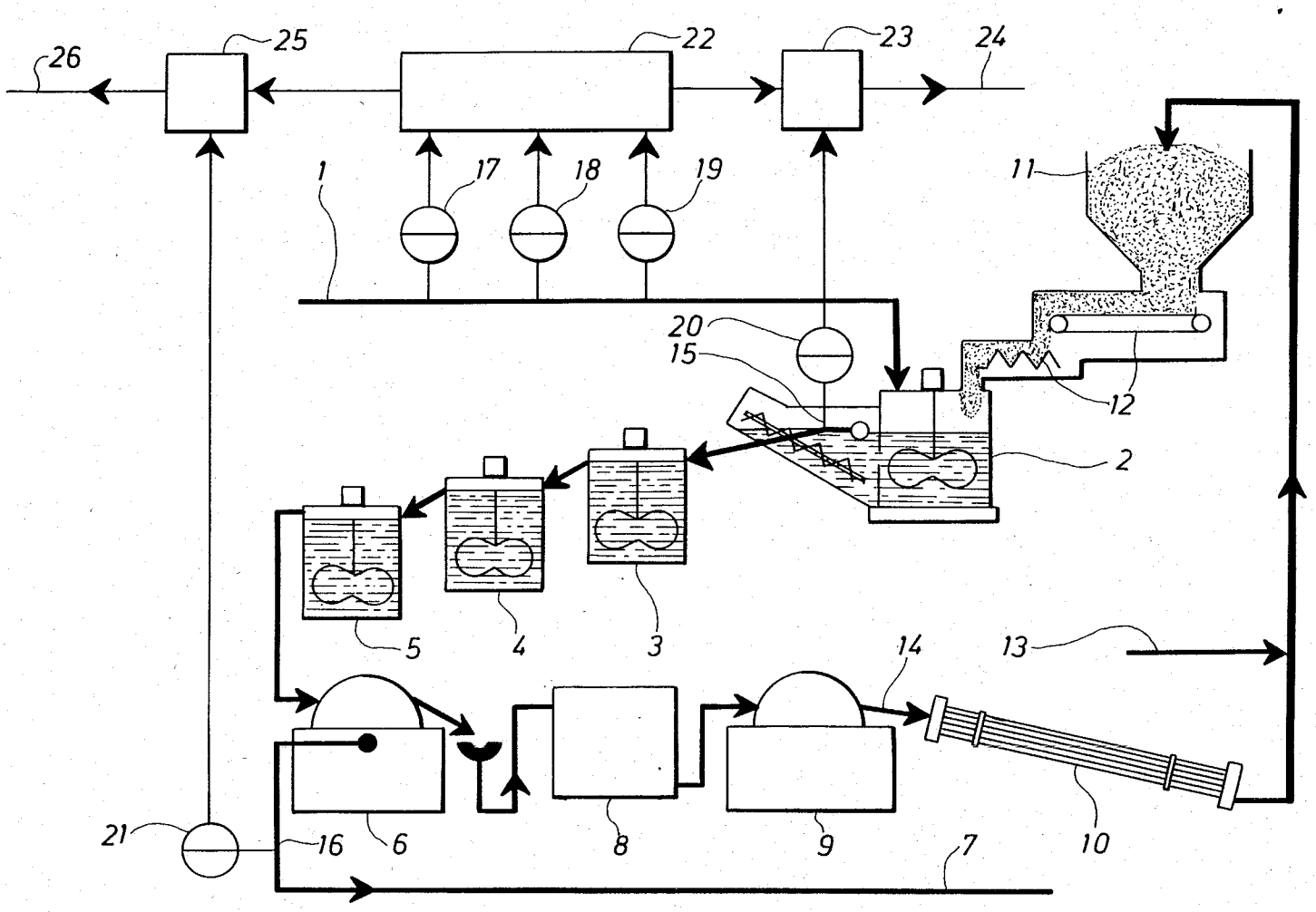
1
2
3
4
5
6
7
8
9
10
11
12
13
14
15
16
17
18
19
20
21
22
23
24
25
26

PROCESS FOR CONTROLLING THE PROPERTIES OF WHITE LIQUOR

BACKGROUND OF THE INVENTION

1. Field of the Invention

The present invention relates to a process for controlling the properties of white liquor used by the preparation of boiling liquor for use in the sulphate process, the electric conductivity of the liquor being measured by said process after the causticization.

By the so-called kraft process or sulphate process pulp is prepared by digesting chips of wood in a strongly alkaline liquor mainly containing NaOH and $Na_2S$. During the pulping, the content of NaOH of the liquor is consumed, said content being relatively high at the beginning, whereas its content of $Na_2S$ remains substantially unchanged.

The spent pulping liquor is called black liquor and contains, inter alia, the dissolved lignin in addition to the residue chemicals. The black liquor is concentrated and subsequently burnt in a steam boiler, whereby its content of energy is utilized. In the bottom of the boiler, the combustion products are collected in the form of a melt mainly consisting of $Na_2S$ and $Na_2CO_3$.

The melt is introduced into a tank with water (thin liquor), wherein it is dissolved. The resulting liquor is called green liquor. The green liquor always contains a small amount of NaOH which may vary a great deal. The green liquor is characterized by having a high content of $Na_2CO_3$ and a small amount of NaOH. In order to re-form the boiling liquor quicklime is added to the green liquor in a slaker, in which the following reactions take place:

Slaking:

$$CaO + H_2O \rightleftarrows CA(OH)_2 \quad (1)$$

Causticization:

$$Ca(OH)_2 + Na_2CO_3 \rightleftarrows 2NaOH + CaCO_3 \downarrow \quad (2)$$

The reactions proceed in parallel towards a state of equilibrium and are more or less displaced to the right. The liquor formed by the causticization is called white liquor.

The content of $Na_2S$ of the green liquor does not take part in the process, but is retrieved in the white liquor. When the amount of water consumed by the reaction (1) is ignored (about 2%), the content of $Na_2S$ of the white liquor is equal to the content of $Na_2S$ of the green liquor. In order to permit a completion of the processes, the liquor is transferred from the slaker to the first of a row of causticizers with stirring. The contents of the first causticization vessel or causticizer are transferred into the next vessel and so on until an overflow is established by the causticizers being positioned in gradually lower heights. The number of causticizers may vary.

Upon termination of the reaction, the causticized liquor (white liquor) is separated from the calcareous silt. Subsequently, the white liquor is used, optionally after additional clarifying, for the preparation of a new pulping liquor. The white liquor and consequently the pulping liquor always contain a small amount of unreacted $Na_2CO_3$. The white liquor is characterized by containing a high amount of NaOH and a small amount of $Na_2CO_3$. The calcareous silt is flushed for liquor residues, dehydrated, and burnt in a rotary kiln whereby the calciumoxide (quicklime) necessary for the causticization is re-formed. The wash water is called thin liquor and is utilized in the dissolving tank for the melt formed from the black liquor, whereby the content of liquor residues of the thin liquor is reused.

As it will appear, the chemicals circulate in two circuits, viz. one for the sodium (the digesting process—the evaprotation—the combustion—the dissolving—the separation from the white liquor—the washing out—the dehydration—the burning). The unavoidable loss of chemicals is as far as the sodium is concerned replaced by addition of $Na_2SO_4$ to the concentrated black liquor. At the combustion, the major part is reduced to $Na_2S$, which results in the name the sulphate process. A small amount of NaOH may furthermore be added to the white liquor. As far as the calcium is concerned, quicklime CaO may be added at the outlet of the rotary kiln, or lime $CaCO_3$ may be added at the inlet of the rotary kiln.

The white liquor and the green liquor may be characterized by some quantitites, the defintion of which is recommended to be used by central laboratories of which for wood or paper pulp in Scandinavia, and which for instance are mentioned in SCAN-N 2:63, whereby the statement of the various chemical substances is to be understood as the concentration of the compound in question, calculated as g of NaOH/l:

Active alkali $AA = NaOH + Na_2S$

Efficient alkali $EA = NaOH + 0.5Na_2S$

Total alkali = all alkali salts.

Total titratable alkali $TTA = NaOH + Na_2S + Na_2CO_3$

The degree of causticization (in white liquor)

$$C = \frac{NaOH}{NaOH + Na_2CO_3} \times 100\%$$

The sulphidity (in white liquor)

$$S = \frac{Na_2S}{NaOH + Na_2S} \times 100\%$$

The degree of reduction (in green liquor)

$$R = \frac{Na_2S}{Na_2SO_4 + Na_2S} \times 100\%$$

Furthermore the following can be mentioned: The reaction of carbonate: $Na_2CO_{3GR}$—$Na_2CO_{3HV}$ g/l The degree of the reaction of carbonate:

$$\frac{Na_2CO_{3Gr} - Na_2CO_{3Hv}}{Na_2CO_{3Gr}} \times 100\%$$

The control of the causticization process may choose the calcium cycle, the sodium cycle or both the calcium cycle and the sodium cycle as starting point.

As far as the sodium cycle is concerned, the difficult steps in the process are centred about the combustion of the concentrated black liquor and the causticization process. By the causticization particularly the control of the addition of quicklime is difficult. This is partly due to the great time lag between the addition of quicklime and the filtration (2–3 hours) of the finished liquor, partly due to the variability of the quicklime both with respect to its reactivity (the slaking velocity) and with respect to its content of active lime. However, the difficulty in controlling the addition of quicklime especially depends on the fact that it has not previously been possible continuously to measure or determine process relevant parameters to be used for the required control.

2. Description of the Prior Art

Previously, the causticization process was often controlled by means of manual regulation of the feeding of quicklime on the basis of laboratory analyses of the white liquor immediately after the slaker and optionally of the green liquor, whereby it was tried to maintain the degree of causticization (in the white liquor) at a predetermined value. This procedure is encumbered with the drawback that it is necessary to wait so long for the result of the analysis that in general it is too late to establish the necessary restoration of the causticization process. Attempts to restore the causticization process may easily involve for instance undue calcareous concretion causing a poorer filtratability and a too high content of calcium in the white liquor whereby filters, pipes, pumps, boilers etc. are calcified, cf. K. Kinzner "Untersuchungen zur Kaustizierung von Grünlaugen," in Proceedings of the Symposium in Recovery of Pulping Chemicals, Helsingfors 1968, page 279. By keeping the specific gravity and consequently the TTA-value of the green liquor constant, it is possible to influence the causticization process positively concerning keeping of the degree of causticization. However, it is not possible to take into account the considerable variation of the quality of the lime by keeping the specific gravity of the green liquor. In addition, the composition of the green liquor may vary considerably irrespective of the fact that the specific gravity and consequently the TTA-value are kept constant. The content of NaOH of the green liquor may for instance vary considerably depending on the amount of water which it is necessary to add to the dissolving tank in addition to the thin liquor in order to dissolve the melt resulting from burning of the concentrated black liquor.

It is known to control the causticization process by means of an automatic titrator for the determination of the content of $Na_2CO_3$ in the green liquor and the white liquor, two temperature measurings being simultaneously performed, viz. a temperature measuring of the green liquor immediately before the slaker and a temperature measuring of the contents of the slaker. The slaking (process 1) involves generation of heat, whereas the causticization (process 2) involves no significant heat content change. The rise in temperature of 10°-15° C. renders it possible to calculate the amount of calcium hydroxide available for the causticization. This calculation renders it possible to control the addition of quicklime, said control being performed in preparation for a constant degree of causticization. An automatic titrator is, however, expensive and must be kept up with analysis reagents, cleaned, and altogether controlled with respect to its function, and it uses time for performing an analysis. The measurings achieved are therefore delayed relative to the moment the necessary control signals should have been given. Consequently, these measurings and the registration thereof cannot be considered on-line. The rise in the temperature measured is relatively modest, and in order to achieve an accurate figure of the amount of calcium hydroxide available for the causticization, the temperatures must be measured individually with great accuracy.

By another known measuring method, the conductivity of the white liquor measured after the slaker is used as a measurement of the degree of causticization, and this measurement is made the basis of the control of the amount of added quicklime. However, the electric conductivity of a solution depends on all the electrolytes present in the elecrolytic solution in question, on their concentration, and on the temperature, since in practice it is always necessary to temperature compensate a conductivity measuring to some reference temperature. The conductivity of the white liquor depends not only on the composition of the liquor concerning NaOH or $Na_2CO_3$ (the degree of causticization), but also on the content of $Na_2S$, and the concentration is of particular importance. Therefore a measuring of the conductivity solely of the white liquor does not permit a good determination of a parameter, on which it is possible to base a control of the degree of causticization.

As it is known, an aqueous solution of NaOH possesses a much higher conductivity than an aqueous solution of $Na_2CO_3$ having the same concentration. An aqueous solution of $Na_2S$ having the corresponding concentration possesses a conductivity between the conductivity measured for the NaOH and the $Na_2CO_3$ solution, respectively.

Furthermore the solution having the highest amount of NaOH among the aqeuous solutions of mixtures of electrolytes containing NaOH, $Na_2S$, and $Na_2CO_3$ possesses the highest conductivity provided the content of $Na_2S$ is constant, the sum of the amounts of substance of said solutions being equal, e.g. calculated as g of NaOH/l or as g of $Na_2O$/l.

Concerning a green liquor and the white liquor derived therefrom by causticization, the sum of the amounts of electrolytes, calculated as g of NaOH/l, is equal in the green liquor and in the white liquor, the content of $Na_2S$ not being influenced by the causticization process. Since the white liquor contains more NaOH than the green liquor from which it is derived, it also possesses a higher conductivity than the green liquor, and this recognition is the basis of the invention.

SUMMARY OF THE INVENTION

The process according to the invention is characterized by measuring the electric conductivity of the green liquor before the causticization in addition to the measuring of the conductivity of the white liquor.

Thus, by measuring the conductivity of the green liquor both before the slaker and gradually as it passes through the slaker, it is possible to achieve a unique picture of the causticization process. The second conductivity measuring is in practice performed either within the slaker or immediately thereafter, in which connection it should be noted that an efficient stirring is maintained within the slaker.

DESCRIPTION OF THE PREFERRED EMBODIMENTS

The conductivity of the white liquor immediately after the slaker is about half as much as the conductivity of the green liquor. Tests have lead to the recognition that the amount of this increase is proportional to the instant degree of the reaction of $Na_2CO_3$ into NaOH, and that the amount of the increase is independent of the content of $Na_2S$ and depends only to a minor degree on the total content of chemicals (TTA) of the green liquor. The reaction of $Na_2CO_3$ into NaOH from one point to another in the process is therefore measureable by a difference measuring of the conductivity by means of two conductivity meters. The high relative increase in the conductivity ensures a very accurate determination of the reaction of carbonate.

It turned out surprisingly, that it is possible to tabulate a formula expression in the form of a fraction, the conductivity of the green liquor and of the white liquor forming part of the numerator, and the TTA-value forming part of an expression of the second degree in the denominator:

$$\frac{\kappa_{Hv} - \kappa_{Gr}}{f_1(TTA)},$$

where $$f_1(TTA) = 4.694 \cdot 10^{-5} \cdot TTA^2 - 2.652 \cdot 10^{-2} \cdot TTA + 7.335 \left(\frac{\text{mS/cm}}{\text{g/l}}\right)$$

The TTA of the green liquor forms part of the resulting expression, but since the variation therein have a relatively minor influence on the accuracy, a TTA-value obtained by measuring an arbitrary parameter is satisfactory, said parameter correlating with the TTA-value to a sufficiently high degree.

The specific gravity turned out for instance to meet said condition, and a preferred embodiment of the process according to the invention is therefore characterized by determining the TTA-value (total titratable alkaline), preferably by measuring the specific gravity of the green liquor or the absorption of a gamma radiation by the green liquor.

As in the following formulae, the formula of the reaction of carbonate is a formula of general application at other temperatures than the temperature actually present provided the conductivities $\kappa_{Gr}$ and $\kappa_{Hv}$ measured are temperature compensated to an appropriate reference temperature t° C. The preferred reference temperature is 90° C., and the formulae thus apply by the use of a reference temperature within a predetermined range about 90° C. According to a further embodiment of the invention, the quantities characteristic for the production plant, preferably x and y, are determined by means of chemical analysis of the green liquor and the white liquor, whereby x is the ratio of the content of $Na_2S$ to the content of $Na_2CO_3$ in the green liquor, both parts being calculated as g of NaOH/l, and whereby y is the ratio of the content of $Na_2S$ in the white liquor, calculated as g of NaOH/l, to TTA.

Instead of the above ratios x and y, it is possible to use arbitrary ratios of the content of NaOH, $Na_2S$, $Na_2CO_3$ and TTA of the green liquor and of the white liquor, respectively, depending on what has shown to be most appropriate based on measurements of working on the plant in question.

A formula expression can be set up, in which the conductivity of the green liquor forms part, whereby the content thereof of $Na_2CO_3$ can be calculated by inserting the numerical value from a measuring of the conductivity and the TTA-value determined by measuring the specific gravity:

$$Na_2CO_{3,Gr} = \frac{f_2(TTA) - \mu_G}{f_1(TTA) + x \cdot f_3(TTA)}$$

-continued where $$f_2(TTA) = -1.158 \cdot 10^{-2} \cdot TTA^2 + 6.939 \cdot TTA + 192.6 \text{ (mS/cm)}$$

$$f_3(TTA) = 5.307 \cdot 10^{-5} \cdot TTA^2 - 2.030 \cdot 10^{-2} \cdot TTA + 3.512 \left(\frac{\text{mS/cm}}{\text{g/l}}\right)$$

Tests have shown that the ratio of the content of $Na_2S$ to $Na_2S$ to $Na_2CO_3$ of the green liquor with a sufficiently good approximation can be equalized with a constant value x characteristic of the causticizing plant in question under the prevailing operational conditions so that the numerical value thereof can be inserted in the formula expression.

Similarly a formula expression can be set up, in which the conductivity of the white liquor forms part, whereby the content hereof of NaOH can be calculated by inserting the numerical value from a conductivity measuring as well as the TTA-value obtained by measuring the specific gravity:

$$\text{NaOH} = \frac{\mu_{HV} - y \cdot f_4(TTA) - f_5(TTA)}{f_1(TTA)}$$

$$f_4(TTA) = -6.129 \cdot 10^{-6} \cdot TTA^3 \cdot 6.226 \cdot 10^{-3} \cdot TTA^2 + 3.823 \cdot TTA \text{ (mS/cm)}$$

$$f_5(TTA) = 2.754 \cdot 10^{-5} \cdot TTA^3 - 1.618 \cdot 10^{-2} \cdot TTA^2 + 3.877 \cdot TTA \text{ (mS/cm)}$$

Tests have shown that the ratio of the content of $Na_2S$ of the white liquor to the TTA-value with sufficiently good approximation can be equalized with a constant value y characteristic of the causticizing plant in question under the prevailing operational conditions so that the numerical value thereof can be inserted in the formal expression.

These measurings render it possible to calculate the reaction of carbonate, the content of $Na_2CO_3$ of the green liquor, the content of NaOH of the white liquor, the degree of reaction of carbonate, the causticizing degree of the white liquor, the sulphidity of the white liquor, the content of active alkali of the white liquor, and/or the content of efficient alkali of the white liquor, and the properties of the white liquor are subsequently controllable on the basis thereof.

Commercially accessible, industrial conductivity meters (e.g. for measuring in accordance with the 4-electrode principle) are today available for the measurings of the electric conductivity. These conductivity meters measure very accurately also in media in which a heavy calcification of the measuring cell must be anticipated. Such conductivity meters are sturdy and accurately measuring instruments which have gained a footing whithin the industry, and which do not require particular tending or keeping up in the form of providing with reagents as for instance in case of a titrator. Such conductivity meters have very short response times and transmit a continuous signal which can be used advantageously for automatic control.

By the process according to the invention, the measuring signals can be used for the control of the properties of the white liquor by regulating the amount of quicklime introduced into the slaker, by regulating the amount of green liquor transferred into the slaker, and- /or by regulating the TTA-value of the green liquor. Consequently the properties of the white liquor are controlled at the same time as the amount of white liquor can be changed in response to the requirements.

For this purpose a data processor is preferably used for on-line registration of the measuring values, for the calculation of the change required of the amount of quicklime added to the slaker per time unit, and/or for the calculation of the change in question of the amount of green liquor fed to the slaker per time unit, and/or for the calculation of the required change of the TTA-value of the green liquor concerning the control of said added amounts or of the TTA-value.

When the process does not pass off in the steady state, its dynamics must be considered, the values of TTA and $\kappa_{Gr}$ then to be inserted in the formulae must be the values registered on that point in the process where $\kappa_{Hv}$ is measured if no causticization took place (no addition of CaO). According to a preferred embodiment of the invention, a small partial flow of the green liquor is removed and transferred to a measuring vessel with stirring and similar to the slaker in such a manner that the volume ratio of the slaker to the measuring vessel is equal to the ratio of the respective amounts of green liquor fed thereto, whereby conductivity measuring and/or a TTA-determination are performed on a corresponding place in the measuring vessel as in the slaker. In this manner the conductivity and the TTA-value of the green liquor measured in the measuring vessel adapted thereto are immediately usable in the formulae as the values aimed at. Nothing, however, prevents said value from being measured directly in the green liquor fed to the slaker, as well as nothing prevents the time lag and "the admixing" from being subsequently simulated by means of calculatable methods to obtain the values aimed at of the conductivity and the TTA in green liquor. Such a simulation of the time lag and the admixing is preferred since it is easily adjustable to the particular mode of operation of various industrial installations.

In the general case the calculation of the reaction of carbonate thus involves the use of a model of the process whereby the time lag and the admixing of the green liquor entering the slaker are considered. This calculation is, of course, carried out by means of the computer system used for on-line registration of the measurements.

Since the causticization process is not fully completed within the slaker, only 70–80% of the reaction taking place within the slaker, and the remaining 20–30% of the reaction taking place in the causticizers, it is by measuring in three or several places possible to provide a still better picture of the passing off of the process.

Especially by measuring the conductivity of the white liquor after separation of the calcareous silt, it is possible to obtain information on the state of the finished liquor for the following preparation of the pulping liquor.

By the process according to the invention it is therefore advantageous to perform the measuring of the conductivity after termination of the causticization within the slaker or the discharge part thereof (the screening part), and/or within one or more of the following causticizers or the outlet conduits thereof and/or within the clarified white liquor.

In this manner the control system used can be adapted to the use of so-called tuning, whereby measuring of the conductivity of the white liquor on two places within the causticizers is compared with the measurement of the conductivity and the TTA-value of the green liquor. The relevant process parameters on the two measuring places are calculated by using dynamic models corresponding to the two places for measuring the conductivity of the white liquor. These white liquor parameters are subsequently applicable for providing a better basis of determination for the operator at manual control or for providing a better basis of determination for the change of the set-value at a PID-regulation (proportional integral differential regulation) or for up-dating the control parameters in a control system in order to optimize the properties of the finished white liquor.

The invention will be described below with reference to the accompanying drawing and an example.

DETAILED DESCRIPTION OF THE DRAWINGS

The drawing is a diagrammatic view of a causticizing plant used in the sulphate process.

Green liquor 1 is formed by dissolving the melt from the combustion of black liquor after concentration, in water and thin liquor, is transferred into a slaker 2 in which slaking and causticization are carried out during addition of quicklime. The resulting precipitate deposited in the screening part is carried out of the slaker by means of a warm conveyor, whereas the content of the slaker of milk of lime passes to causticizers 3, 4, and 5 through overruns. From the last causticizer, the white liquor is carried together with calcareous silt to a separating and washing filter 6. From this filter the filtrated white liquor continues to a storage tank (not shown). The washed calcareous silt is transferred into a vessel 8 and further to a dehydration filter 9. Subsequently, the calcareous silt is carried to a rotary kiln for burning, whereby supplementing lime (not burnt) can be added immediately before the rotary kiln at 14. The quicklime which can be supplemented with quicklime 13 is transferred to a lime silo 11, a conveyor mechanism 12 for the lime being situated below said silo. This conveyor mechanism 12 carries the quicklime into the slaker 12.

The process variables mentioned in the following example are for instance desired to be determined on two places in the causticizing plant, place A and place B referred to as 15 and 16, respectively. A flowmeter 17, a densimeter 18 (measuring the TTA-value), a conductivity meter 19 (green liquor), a conductivity meter 20 (white liquor immediately after the slaker), and a conductivity meter 21 (the completed white liquor) are used for this purpose.

The delayed values of TTA and the conductivity of the green liquor are calculated in a calculation unit 22, and the signals in question are transferred to calculation unit 23 and 25 also supplied with the signals from the conductivity meters 20 and 21, respectively. On the places A and B, the process variables are calculated in the calculation units 23 and 25, and based on these variables control signals 24 and 26 and are transmitted for the desired control of added amount of quicklime per time unit, added amount fo green liquor per time unit or the TTA-value in the green liquor.

EXAMPLE

In a paper pulp producing plant, the following measurings were carried out in the causticizing plant after a long period of steady state, whereby comparison with laboratory analyses can be carried out:

$\kappa Gr$, 90° C. = 498.0 mS/cm $\kappa Hv$, 90° C. = 723.3 mS/cm $Vf_{90°C.} = 1.135$ kg/l ~ TTA = 142.2 g/l The quantities x and y characteristic of the process are found from the average value of 9 weeks' laboratory analyses as follows:

$$x = \frac{Na_2S_{Gr}}{Na_2CO_{3Gr}} = 0.2772$$

$$y = \frac{Na_2S_{HV}}{TTA} = 0.1677$$

In the following, all the concentrations of substance have been stated as g of NaOH/l. The connection between specific gravity (90° C.) and TTA was found to be:

$$TTA = Vf_{90} \cdot 962.2 - 949.9 \text{ (g/l)}$$

$$R = 92\%$$

whereby the specific gravity at 90° C. and the figures 962.2 and 949.9 are obtained by means of a row of measurings of the specific gravity and corresponding chemical analyses for the determination of the TTA-value based on linear regression, and R is the correlation factor.

Reaction of Carbonate $$\text{Reaction of carbonate} = \frac{\kappa_{Hv} - \kappa_{Gr}}{f_1(TTA)} \quad (1)$$

where $$f_1(TTA) = 4.694 \cdot 10^{-5} \cdot TTA^2 - 2.652 \cdot 10^{-2} \cdot TTA + 7.335 \left(\frac{\text{mS/cm}}{\text{g/l}}\right)$$

Illustrated with figures:

$$\text{Reaction of carbonate} = \frac{723.3 - 498.0}{4.513} = 49.9 \text{ g/l}$$

$Na_2CO_3$ in green liquor $$Na_2CO_{3,gr} = \frac{f_2(TTA) - \mu_G}{f_1(TTA) + x \cdot f_3(TTA)} \quad (2)$$

where $$f_2(TTA) = -1.158 \cdot 10^{-2} \cdot TTA^2 + 6.939 \cdot TTA + 192.6 \text{ (mS/cm)}$$

$$f_3(TTA) = 5.307 \cdot 10^{-5} \cdot TTA^2 - 2.030 \cdot 10^{-2} \cdot TTA + 3.512 \left(\frac{\text{mS/cm}}{\text{g/l}}\right)$$

Illustrated with figures:

$$Na_2CO_{3,Gr} = \frac{945.2 - 498.0}{4.513 + 0.2772 \cdot 1.6985} = 89.7 \text{ g/l}$$

NaOH in white liquor $$NaOH = \frac{\mu_{Hv} - y \cdot f_4(TTA) - f_5(TTA)}{f_1(TTA)} \quad (3)$$

-continued $$f_4(TTA) = -6.129 \cdot 10^{-6} \cdot TTA^3 - 6.226 \cdot 10^{-3} \cdot TTA^2 + 3.823 \cdot TTA \text{ (mS/cm)}$$

$$f_5(TTA) = 2.754 \cdot 10^{-5} \cdot TTA^3 - 1.618 \cdot 10^{-2} \cdot TTA^2 + 3.877 \cdot TTA \text{ (mS/cm)}$$

Illustrated with figures:

$$NaOH = \frac{723.3 - 0.1677 \cdot 400.1 - 303.3}{4.513} = 78.2 \text{ g/l}$$

Degree of reaction of carbonate $$\frac{\text{Reaction of carbonate}}{\text{Carbonate in green liquor}} \cdot 100\% = \frac{49.9}{9.7} \cdot 100\% = 55.7\%$$

Causticizing degree of white liquor $$C\,\% = \frac{NaOH_{HV}}{Na_2CO_{3,Gr} - \text{reaction of carbonate}} \quad (5)$$

$$C\,\% = \frac{78.2}{89.7 - 49.9 + 78.2} \cdot 100\% = 66.3\%$$

The sulphidity of white liquor $$S\,\% = \frac{Na_2S_{HV}}{NaOH_{HV} + Na_2S_{HV}} \cdot 100\% \quad (6)$$

$$Na_2S_{HV} = TTA - NaOH_{HV} - Na_2CO_{3HV},$$

$Na_2CO_{3HV} = Na_2CO_{3,Gr}$ − reaction of carbonate providing $$S\,\% = \frac{TTA - NaOH_{HV} - Na_2CO_{3,Gr} + \text{reaction of carbonate}}{TTA - Na_2CO_{3,Gr} + \text{reaction of carbonate}}$$

Illustrated with figures:

$$S\,\% = \frac{142.2 - 78.2 - 89.7 + 49.9}{142.2 - 89.7 + 49.9} \cdot 100\% = 23.6\%$$

Active alkali in white liquor $$AA = NaOH_{HV} + Na_2S_{HV} \quad (7)$$

$$= TTA - Na_2CO_{3HV} = TTA + Na_2CO_{3,Gr} - \text{reaction of carbonate}$$

Illustrated with figures:

$$AA = 142.2 + 49.9 - 89.7 = 102.4 \text{ g/l}$$

Efficient alkali in white liquor $$EA = NaOH_{HV} + \tfrac{1}{2}Na_2S_{HV} \quad (8)$$

$$= NaOH_{HV} + \tfrac{1}{2}(TTA - NaOH_{HV} - Na_2CO_{3HV})$$

$$= \tfrac{1}{2}(NaOH_{HV} + TTA - NaCO_{3,Gr} + \text{reaction of carbonate})$$

Illustrated with figures:

$$EA = \tfrac{1}{2}(78.2 + 142.2 - 89.7 + 49.9) = 90.3 \text{ g/l}$$

I claim:

1. A method of controlling the causticizing process of green liquor in the sulphate process, which produces an alkaline white liquor for pulping of wood, comprising:

(a) measuring immediately after the causticizing process, the value of the electric conductivity of the white liquor formed thereby;

(b) measuring immediately before said causticizing process, the value of the conductivity of the green liquor being fed into said process;

(c) numerically correlating the conductivity of said white liquor and said green liquor to obtain the reaction of carbonate value for said causticizing process by means of the mathematical equation (I)

$$\text{Reaction of Carbonate} = \frac{K_{Hv} - K_{Gr}}{f_1(TTA)}$$

wherein $$f_1(TTA) = 4.694 \times 10^{-5} \times TTA^2 - 2.652 \times 10^{-2} TTA + 7.335 \frac{\text{mS/cm}}{\text{g/l}};$$

$K_{Hv}$ and $K_{Gr}$ are the conductivities of the white liquor and the green liquor, respectively and TTA is the total titratable alkali of the green liquor; and (d) adjusting the reaction of carbonate of said causticizing process based on the reaction of carbonate value obtained in step (c).

2. The method of claim 1, further comprising: wherein the value of the total titratable alkali of said green liquor is obtained by (e) measuring the gamma ray absorption of said green liquor.

3. The method of claim 1 further comprising:

(e) constantly removing a small part of the green liquor immediately prior to entering a slaker wherein said causticizing process begins; and (f) transferring said part to a vessel thereof; whereby a further measurement of the conductivity of said green liquor can be made; the volume ratio of said vessel to said slaker being equal to the volume ratio of the respective parts of green liquor fed thereto.

4. The method of claim 1, further comprising:

(e) on-line transferring said measured values obtained in steps (a) and (b) to a data processor to calculate the degree of adjusting of the reaction of carbonate of step (d) per unit time.

5. The method of claim 1 wherein step (d) is carried out by adjusting the amount of quick lime, or the amount of the green liquor, or a combination thereof, being fed per unit time to a slaker wherein said causticizing process begins.

6. The method of claim 1, wherein the conductivity of said white liquor of step (a) is measured within a slaker wherein said causticization process begins, within one or more causticizers whereto the partially causticized white liquor is transferred therefrom, at the outlet of one or more of the causticizers whereby the causticized white liquor is discharged from said causticizers, or a combination thereof.

7. The method of claim 1, further comprising:

(e) measuring the value of the specific gravity of the green liquor to obtain the value of the total titratable alkali of said liquor.

8. The method of claim 7 further comprising:

(f) chemically determining the value of the concentration of $Na_2S$ and of $Na_2CO_3$ in said green liquor, to obtain the values x and y; wherein x is the ratio of the value of the concentrations of said $Na_2S$ and said $Na_2CO_3$ expressed as g NaOH/l and y is the ratio of the value of the concentration of $Na_2S$ in said white liquor and the value of said total titratable alkali of said green liquor expressed as g NaOH/l; and (g) then using said x and y values in step (d) for adjusting the reaction of carbonate of said causticizing process.

9. The method of claim 7, further comprising:

(f) on-line transferring said measured value of specific gravity to a data processor to calculate the degree of adjusting of the reaction of carbonate of step (d) per unit time.

10. The method of claim 7 wherein step (d) is carried out by adjusting the amount of quick lime, the value of the total titratable alkali or the amount of the green liquor, or a combination thereof being fed per unit time to a slaker, wherein said causticizing process begins.

11. The method of claim 7 further comprising:

(f) constantly removing a small part of the green liquor immediately prior to entering a slaker wherein said causticizing process begins, and (g) transferring said part to a vessel thereof, whereby a further measurement of the conductivity and/or the specific gravity of said green liquor can be made; the volume ratio of said vessel to said slaker being equal to the volume ratio of the respective parts of green liquor fed thereto.

12. The method of claim 7, wherein the conductivity of said white liquor of step (a) is measured within a slaker wherein said causticization process begins, within one or more causticizers whereto the partially causticized white liquor is transferred therefrom, at the outlet of one or more of the causticizers whereby the causticized white liquor is discharged from said causticizers, or a combination thereof.

* * * * *